United States Patent [19]

Schenker

[11] 4,382,461

[45] May 10, 1983

[54] STAND-OFF SHIELD FOR UNCOVERED REFRIGERATED UNITS

[76] Inventor: Allan Schenker, 17046 Burbank Blvd., #8, Encino, Calif. 91316

[21] Appl. No.: 293,672

[22] Filed: Aug. 17, 1981

Related U.S. Application Data

[63] Continuation-in-part of Ser. No. 38,230, May 11, 1979, Pat. No. 4,310,044.

[51] Int. Cl.[3] ..... F06B 3/80

[52] U.S. Cl. ..... 160/329

[58] Field of Search ..... 160/327-329, 160/332, 184, 264, DIG. 8; 312/297

[56] References Cited

U.S. PATENT DOCUMENTS

| | | | |
|---|---|---|---|
| 2,240,416 | 4/1941 | Pidgeon | 160/264 |
| 2,560,661 | 7/1951 | Poovey | 160/DIG. 8 |
| 4,186,790 | 2/1980 | Schenker et al. | 160/329 |
| 4,296,792 | 10/1981 | Gidge et al. | 160/332 |
| 4,313,485 | 2/1982 | Gidge et al. | 160/332 |

*Primary Examiner*—Peter M. Caun

*Attorney, Agent, or Firm*—Spensley, Horn, Jubas & Lubitz

[57] ABSTRACT

Energy losses from market refrigerated display cases, which are normally open, can be dramatically reduced by the use of the shield assembly of the present invention. The shield assembly comprises of plurality of transparent and resilient panels, each panel being adjacent to at least one another and having an overlapping relationship with the adjacent panel. The panels are mounted in a rigid frame and allow access therethrough by stretching and bending one or more of the panels along the overlap. The plurality of panels are fitted in a specifically configured mounting means such that they are held in place across an aperture of the display case. Retaining means are disposed adjacent the other end of the panels to keep the shield assembly in proper position.

25 Claims, 9 Drawing Figures

STAND-OFF SHIELD FOR UNCOVERED REFRIGERATED UNITS

BACKGROUND OF THE INVENTION

1. Related Application

The present application is a continuation-in-part of application Ser. No. 38,230, filed May 11, 1979 and now U.S. Pat. No. 4,310,044.

2. Field of the Invention

The present invention relates to the field of refrigerated display cases, and in particular to means for temporarily opening and closing apertures of such refrigerator cases and related devices.

3. Description of the Prior Art

Refrigerated display cases in markets have typically used opened units some having horizontal openings and some having generally vertically openings. Those cases where the refrigerator unit has been provided with a barrier over the access opening, typically use a sliding or hinged glass door.

The use of glass doors over refrigerated display openings has been limited do to the inconvenience of use, the high expense of installation, and high maintenance cost where the glass is subject to breakage, scratching, requires added electrical to heat the glass and the like. In many applications, glass doors have provided only limited and restricted access to a portion of the refrigerated case. They can also be difficult to open. What has thus been needed for a long time is a cover assembly for use with refrigerated display cases which is simple, rugged, economical and which provides substantially free access into and out of the refrigerated case by effectively isolating the interior of the case from the ambient environment, with little change in shopping habits and manner.

One solution to the above noticed problem is disclosed in my co-pending application which is herein incorporated by reference. That invention is directed to an apparatus which comprises a shield disposed across an aperture across which a temperature gradient is maintained while still permitting of substantially free access therethrough. That apparatus comprises a plurality of substantially transparent panels and a means for disposing the plurality of panels across the aperture and tensioning the same. By reason of this combination, a barrier is formed across the aperture without substantially prohibiting free movement therethrough.

The present invention is directed to yet a further improvement and has specific applicability in connection with more recently evolved refrigeration units. More specifically, with respect to upright freezer cases, such cases which do not include doors or other types of panels, initially used a "band" of refrigerated air, at approximately −40° F. which circulated through the case. The obvious problems with such type of case is that the refrigerated air spilled out over the case into the environment. Moreover, to maintain the air at this low temperature, large compressor units had to be used. The art then evolved the use of a a second "band" of air in some designs at approximately 20° F. which was used to cover the first band. This proved to be a distinct improvement over the prior art in that the second band of air helped retain most of the very cold air within the case, and prevented it from spillage out into the environment.

Recently, some refrigerated cases have been equipped such that an exterior band of ambient air drawn in by fans from points above the top of the refrigerated case across the inner bands and then outside of the case adjacent the bottom thereof. In this manner, the colder band(s) of air are blanketed by the band of ambient air. However, while such a freezer case is more efficient than those of the prior art, its efficiency can be substantially increased by the mere mounting of a panel across its front. As discussed above, the use of doors create a number of problems. Moreover, if these newer cases were retrofitted with doors, the exterior band of air would serve no useful purpose and unless removed may even cause severe problems as it cannot escape from the case.

The device of the present invention can be used with such double or triple air band refrigerated cases so as to substantially improve the efficiency, without causing problems such as associated with many prior art devices. It can also be used with cases of substantially different construction and air flow patterns.

BRIEF SUMMARY OF THE INVENTION

The present invention is directed to a novel cover or shield assembly for thermally isolating an aperture in a refrigerated case while permitting access to the aperture. The shield assembly comprises a plurality of resilient, substantially transparent panels each having first and second ends. The panels are arranged and configured in a particular overlaping, side-by-side configuration. A tension bar or rod is disposed along the length of the panels, and selectively retains the panels in a predetermined configuration. Mounting means are disposed adjacent he first end of the panels for mounting the panels to an associated refrigerated case such that the panels extend across the aperture. Finally, maintaining means are disposed adjacent the other end of the panels for selectively maintaining the panels across the aperture. In this manner, while direct access through aperture into the refrigerated case can be achieved, a substantially better thermal barrier is formed across the aperture so as to preclude the flow of refrigerated air outward from the case.

The novel features which are believed to be characteristic of this invention, both as to its organization and method of operation, together with further objective and advantages thereof will be better understood from the following description considered in connection with the accompanying drawings in which the presently preferred embodiment of the invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

The present invention is directed to a shield assembly for thermally isolating an aperture in a refrigerated case from the ambient environment while permitting ready access into and through the aperture. The shield assembly comprises a plurality of resilient, substantially transparent panels, wherein the panels are in an adjacent and overlapping configuration. The panels are specifically mounted on the refrigerated case such that thermal energy flowing across the aperture is prevented from exiting into the ambient environment. However, the panels are also disposed in a manner such that an outward band of ambient air associated with many types of refrigerated cases can pass between the panels and the case and exit adjacent the bottom of the case.

Figure 1:
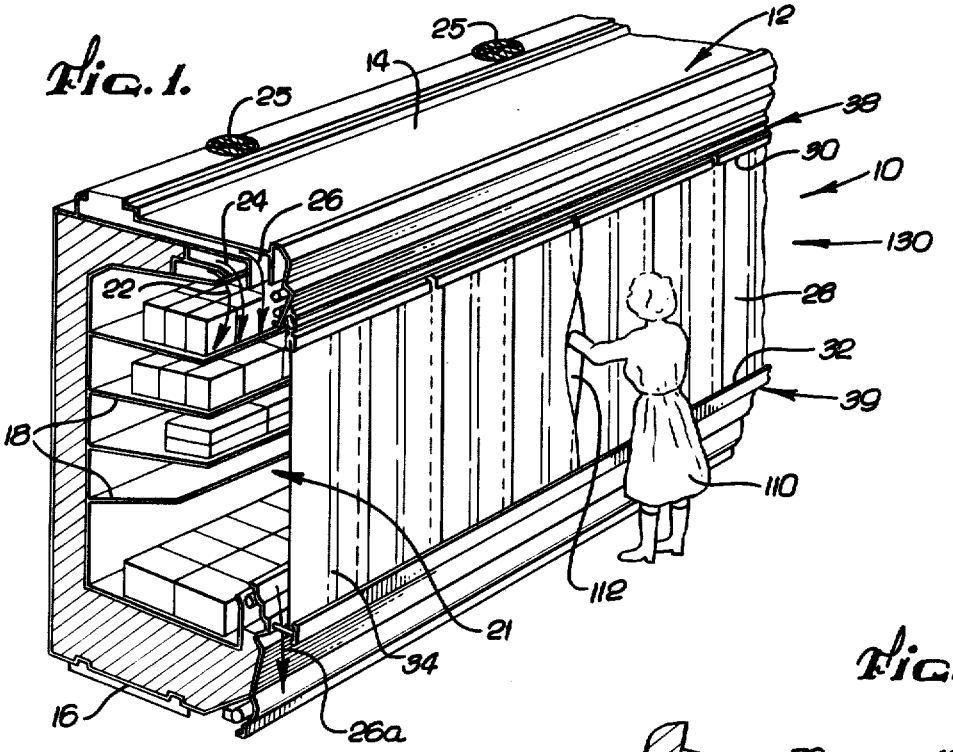
FIG. 1 is a perspective view showing the shield assembly across a typical refrigerated case.

Referring now specifically to FIG. 1, the shield assembly 10 of the present invention is generally illustrated. In the preferred embodiment, shield assembly 10 is attached to a refrigerated case which has a top 14, a bottom 16, and various shelves 18. Such types of cases are found in many food stores. In use, one would reach into opening or aperture 21 and remove various goods such as a package of frozen peas, a salami, milk products or the like. One type of refrigerated case 12 has a first band of refrigerated air generally indicated by arrow 22 which has been cooled to a temperature of approximately −40° F. This super-cold air keeps the food at or below the freezing point and thus preserving freshness. An optional second band of air generally indicated by arrow 24 is maintained at approximately 20° F. and serves as a first layer of insulation so as to preclude air band 22 from having direct contact with the environment. Bands 22 and 24 recirculate through case 12. Finally, another band of air generally indicated by arrow 26, at ambient temperature, is drawn in adjacent the top 14 of the case 12 by fans 25, and flows outside of the other bands. This exterior band of air acts as a barrier by controlled air pattern. Because it is not cooled, and acts specifically as a layer of insulation, band 26 flows out of the case 12 across the front 20 as is generally indicated by arrow 26*a*, it is not recirculated.

Figure 5:
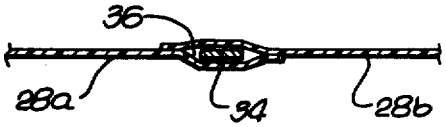
FIG. 5 is a cross-sectional view of a panel showing an internally located tension bar.

Adjacent the top 14 of case 12, various panels of the present invention have been mounted. A typical panel 28 has first end 30 and second end 32. A tensioning bar 34, perhaps best seen in FIG. 5, is disposed along the length of each of the panels 28 in the preferred embodiment. Such bar 34 is made of a spring-type metal and enables the panels 28 to be maintained a long period of time in a predetermined position. It also causes realignment of panels 28 to their original position after they are moved. However while a bar 34 is preferably used, other types of stiffening and tensioning elements are included within the scope of the present invention. For example, bar 34 could have a variety of cross-sections other than generally rectangular, and could extend only partially down the length of each of the panels 28. As shown in FIG. 5, panel 28 is preferably made of a first section 28*a* and second section 28*b* which have been joined together along their length so as to form a channel 36 through which the bar 34 extends. Panel 28 could also be made with a pocket into which the bar 34 would be inserted.

A mounting means generally indicated by element 38 is attached to the refrigerated case 12 adjacent the front 20 and, along with positioning means 39, are designed to maintain the panels 28 in a predetermined configuration. In the preferred embodiment, mounting means 38 and positioning or maintaining means 39 are designed to maintain the panels 28 such that they are a predetermined distance away from the front 20 of the case 12. In this manner, band of air 26 can flow between panels 28 and the case 12, and not back into the case 12.

Figure 3:
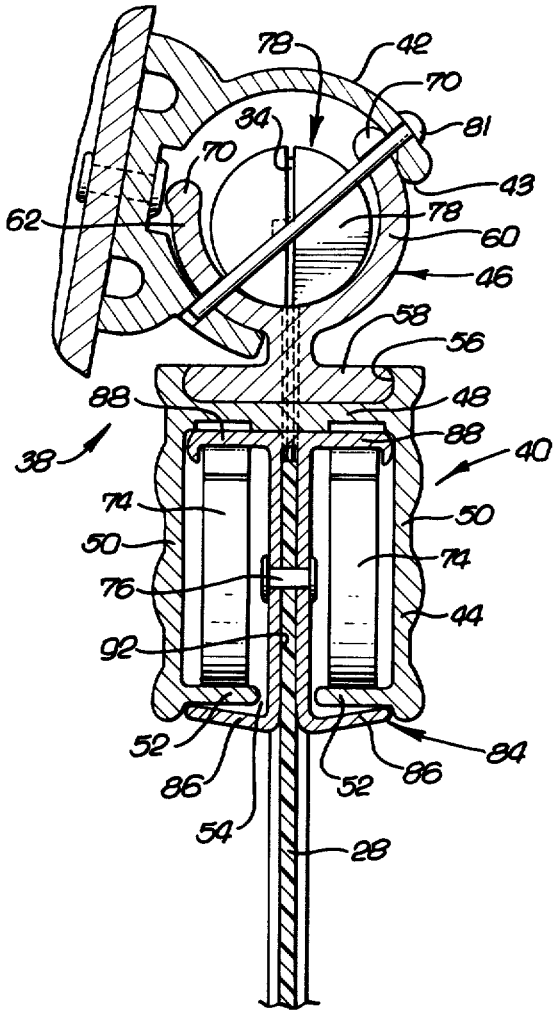
FIG. 3 is a partial cross-sectional view of the mounting track and rail assembly used to mount the shield assembly to an associated refrigerated case.
Figure 4:
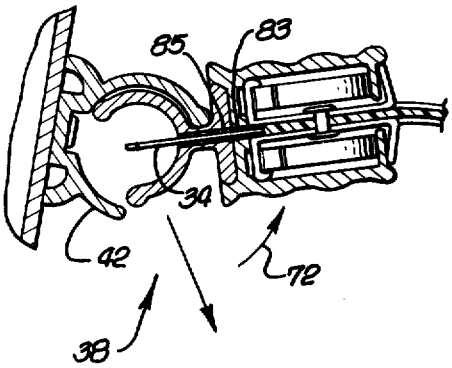
FIG. 4 is another cross-sectional view of the track and rail assembly showing how they can be disengaged.

Referring now to FIGS. 3 and 4, one can see that mounting means 38 comprises a first member or rail assembly 40 and a second member or mounting track 42. Track 42 has a generally arcuate cross-section and defines an open slot 43 which extends along the length thereof. Rail assembly 40 comprises a rail housing 44 which has a generally rectangular configuration, and an outwardly extending arcuate guide member 46 which extends into and is rotatably held by the mounting track 42. Housing 44 has a base 48, various side walls 50 and internally disposed lateral projections 52 defining a gap 54 therebetween. A space 56 is defined in base 48 and is configured so as to engage base 58 of the guide member 46. Opposite the guide member 46 and disposed within housing 44 are spring members 74. Spring member 74 provides tension to the panels 28 as described in greater detail below.

Guide member 46 has a first long arm 60 and second short arm 62, and is specifically designed and configured so as to rotate as indicated in FIG. 4 within the track 42 about its longitudinal axis. A protrusion 70 located adjacent each end of each of the arms 60, 62 prevents excessive friction and premature escape of the rail assembly 40 from the track 42. Upon rotation of the rail assembly 40 in track 42, such as indicated by arrow 72, detachment of one element from the other can be achieved.

Figure 6:
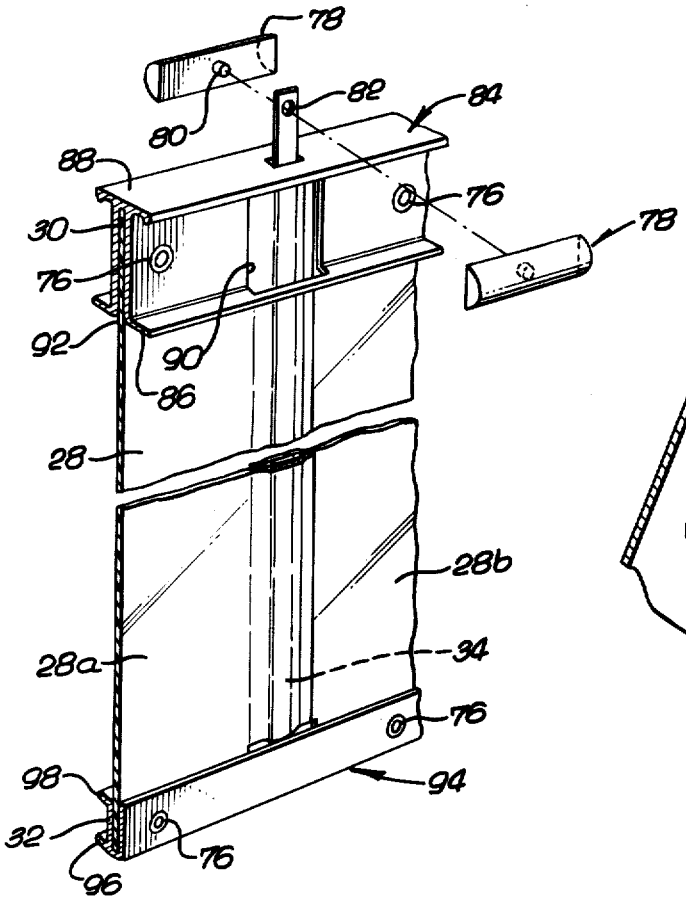
FIG. 6 is a perspective view showing a panel assembly, tension bar and various cuff members disposed adjacent each end of the assembly.

Referring now to FIGS. 3 and 6, one can see that a joining member or twist lock 78 sandwiches as the oblong bar 34 therebetween. More specifically, a pin 80 extends from one half of twist lock 78, through an opening 82 in the bar 34 so as to engage the other half of the twist lock 78. Twist lock 78 is held within the arcuate configuration of guide member 46 and rigidly secures the rod 34 in position. Optionally or in combination, a pin 81 is extended through housing 44 as shown in FIG. 3 and joins arms 60, 62 with the arms of the track 42. This enables the panels 28 to be held in a variety of positions. If only pin 81 is used, bar 34 would extend through a slot 83, or other means to prevent its rotation, and through opening 85 formed in the guide member 46. This enables bar 34 to "float," but still maintains the panels 28 in a selected position.

The panel 28, as shown in FIGS. 3 and 6, and more specifically first end 30, is disposed in a first deep cuff 84 by adhesive and/or by means of a plurality of rivets 76. It should be understood that other means for joining panel 28 to cuff 84 are obviously within the scope of the present invention. The second end 32 of each of the panels 28 is joined to shallow cuff member 94. Deep cuff 84 is comprised of first outwardly extending flanges 86 which engage lateral projections 52, and second outwardly extending flanges 88 are disposed within the rail housing 44 and are held under tension by means of spring 74 against base 48. Thus, pulling down on panel 28 would cause flange 88 to disengage from base 48. Upon release, the panel 28 would return to the original position as shown in FIG. 3. In this manner stress is transferred from edges of sections 28*a* and 28*b* (FIG. 5) into and on springs 74, One (1) such spring 74 is in each channel of cuff 84, if required.

Located adjacent the center of each of the deep cuff members 84 is an opening 90 through which the rod 34 extends. A slot 92 is formed in cuff 84 and the panel 28 extends into slot 92 and is retained therein by means of adhesive and/or rivets 76 as discussed above. In the preferred embodiment, two sections 28*a* and 28*b* and thus one panel 28, are held in each cuff 84. Two such cuffs 84 are inserted into each section of housing 44.

Shallow cuff 94, attached to the second end 32 of panel 28, is comprised of first outwardly extending flanges 96 and 98. A slot 99 engages the second end 32 of the panel 28 and holds the panel therein by means of rivets 76 or adhesive such as discussed with respect to the deep flange 84.

Figure 7:
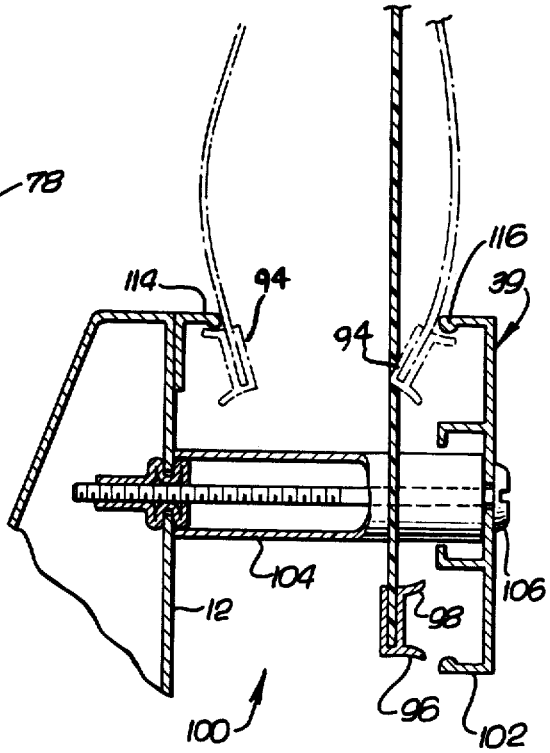
FIG. 7 is a cross-sectional view showing how a panel is retained between the case and an outwardly extending railing assembly.

Referring now to FIG. 7, one can see railing assembly 100 which, along with cuff 94 forms one example of positioning means 39 for positioning the panels 28 across the refrigerator case 12. Railing assembly 100 consists of rail member 102 and spacer 104 which separates the rail member 102 from the case 12. Rail member 102 and spacer 104 are held in position by a screw member 106. Of course, other means such as a bolt or the like are within the scope of the present invention.

The operation of the shield assembly 10 of the present invention will now be discussed.

Referring again to FIGS. 1 and 2, a refrigerated display case 12, such as discussed hereinabove which has three bands of air is illustrated. An array 130 of panels 28 are shown to be disposed across the opening or aperture 21 of the case 12. Typically, the panels 28 are substantially transparent, thereby permitting the consumer 110 to freely view the contents of the refrigerated display case 12. The array 130 substantially closes aperture 21 thereby reducing the amount of thermal energy lost across aperture 21 to the ambient environment. When the consumer 110 desires to make a selection and remove an article from the interior of the refrigerated display case 12, it is merely necessary to place the hand through the array 130, and more specifically, through opening 112, and grasp the underlying article. The panels 28 will yield or give way to permit both the consumer's hand to be thrust inward to the interior of the refrigerated case 12 and to permit the withdrawal of even bulky articles such as frozen turkeys, without substantial interference.

Figure 2:
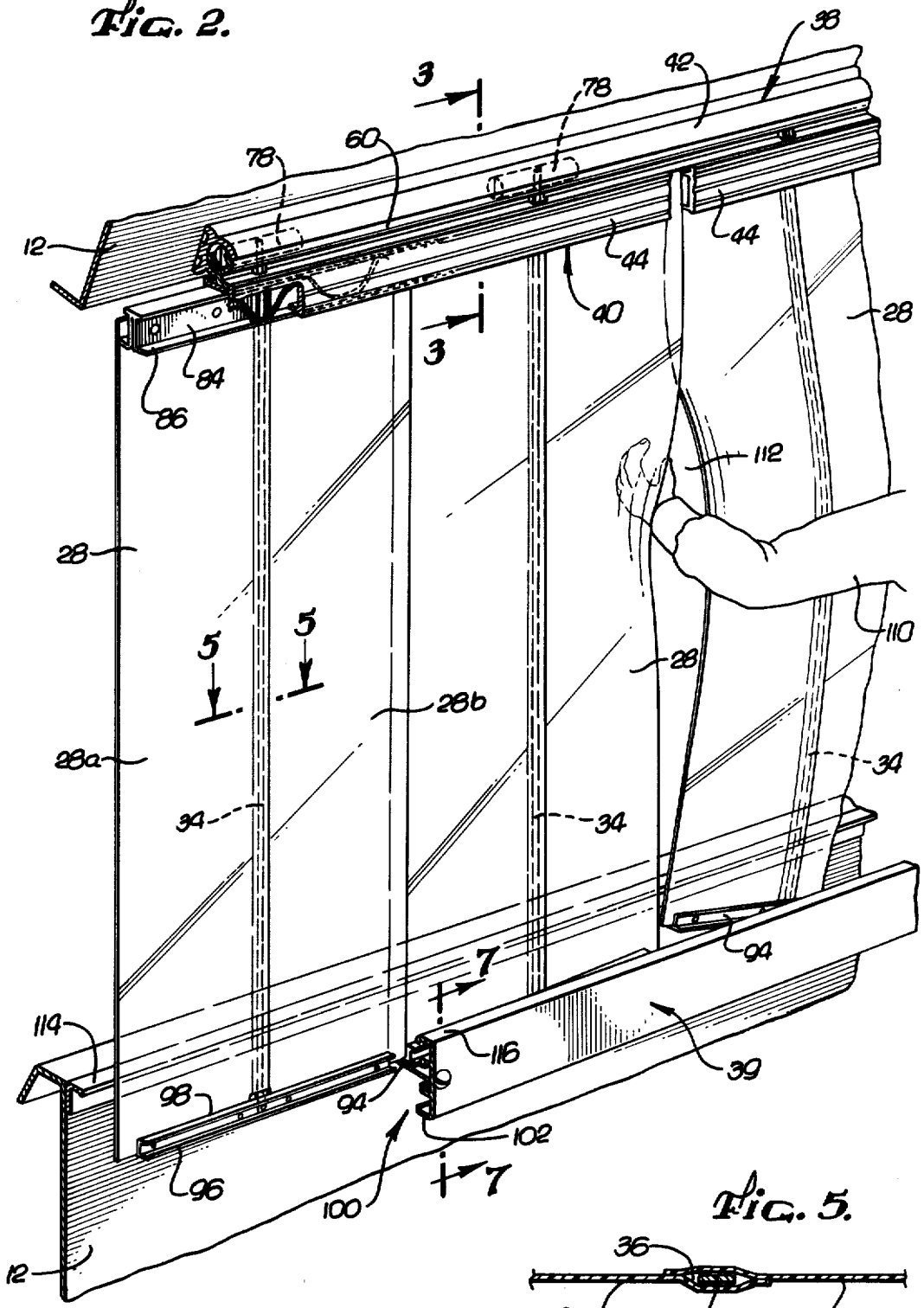
FIG. 2 is another perspective view showing the shield assembly in greater detail.

To accommodate the insertion of the consumer's hand and arm between adjacent panels 28, the uniquely configured mounting means 38 and positioning means 39 (FIG. 1) are utilized. Mounting means 38, comprised of rail assembly 40 and mounting track 42, permits some give in each of the panels 28 as provided for by means of tension spring 74. In addition, guide member 46 can be rotatably disposed within the track 42, and thus some inward and outward movement is also permitted without disengagement if desired. Alternatively, panels 28 can be secured in a fixed position by means of pin 81 or other locking devices, catches or latches. In this embodiment, panels 28 could be positioned such that it abuts against rail member 39 (FIG. 2 or 7). Outward positioning would permit an ambient air band, band 26 to readily flow between the panels 28 and the case 12. As shown in phantom lines in FIG. 7, panels 28 are prevented from escaping assembly 100 by engagement of flange 98 with arm member 116.

Referring again to FIG. 7, one can see that cuff 94 can be reversed such that if the panel 28 is pushed toward the interior of the case 12, the possibility that the panel 28 might be completely pushed into the case 12 is prevented by engagement of arm member 114 by flange 98.

After the item is selected and removed, tensioning bar 34 urges panels 28 away from case 12 so as to abut against railing assembly 100.

Figure 8:
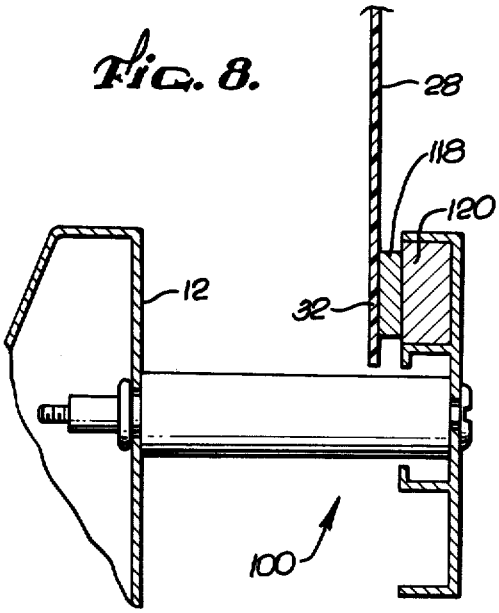
FIG. 8 shows another embodiment for retaining a panel in a predetermined position with respect to the case.

In a second embodiment shown in FIG. 8, rather than use a cuff 94, a magnet 118 can be attached along the second end 32 of the panels 28. This magnet 118 would engage a magnet 120 disposed on the railing assembly 100. In this manner, the panels 28 can also be held away from the front 20 of case 12.

Attachment of the shield assembly 10 to case 12 is also relatively simple and straightforward. Mounting track 42 is attached directly to the case 12 as shown in FIGS. 1 and 2 by means for screws, bolts and the like. Because guide member 46 is rotatably joined to track 42, track 42 can be mounted at various angles while still permitting ready attachment with member 46. Railing assembly 100 is likewise easily installed to the case 12 as shown in FIG. 7. After assembly 100 is attached, panels 28, and more specifically, guide member 46 are inserted into mounting track 42. Stocking of the shelves 18 is not hindered by assembly 10 as the panels 28 can be twisted and removed from the railing assembly 100, and then held off to the side. In addition, the panels 28 can be totally removed by rotation and removal of guide 46 from track 42 as illustrated in FIG. 4.

Figure 9:
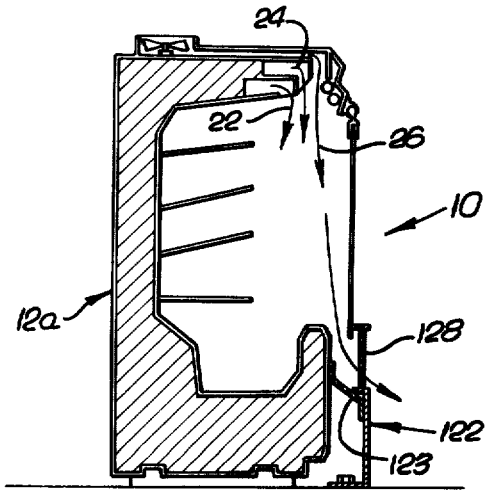
FIG. 9 shows an embodiment wherein the shield assembly is used on a refrigerated case of an alternate construction.

The broad concept of the present invention is also clearly applicable to refrigerated cases of alternate design such as freezer case 12*a* shown in FIG. 9. In this embodiment, the case 12*a* is designed such that air band 26 flows over the front of the case 12*a*. If one does not want to mount assembly 10 to case 12*a* by means of railing 100, a separate sub-panel vent assembly 122 can be used. Assembly 122 includes a trough 123 which directs the outer band of air 26 exterior to the case 12*a* and through vents 128. In this case, panels 28 would be positioned adjacent railing 100 as shown in FIG. 7.

Although the present invention has been described in connection with the particular embodiment shown and discussed hereinabove, it is to be expressly understood that many other alterations and modifications may be made by those having ordinary skill in the art without departing from the spirit and scope of the present invention. For example, a wide variety of means can be used so as to properly place the panels 28 across the aperture 21 such that they maintain a predetermined distance away from the case 12. It has been found that even without internal stiffening elements 34 alone, in some embodiments proper placement can be achieved. Thus, in some situations stiffening element 34 can be removed and a magnet or other means, such as discussed with reference to FIG. 8, utilized.

It is respectfully submitted that what has been described hereinabove is a unique apparatus for reducing the power consumptions primarily, but not limited, to supermarket refrigerated display case. It is expected that the present invention will extend the life of refrigeration equipment, such as motors, generators and compressors, as well as decreasing maintenance required on the same. Refrigeration units, incorporating the present invention's design, may also be built with smaller refrigeration capacities and therefore may be built in a more economical manner. In addition, advantages can be obtained with respect to space, air conditioning and heating in markets employing a large number of open display refrigerator devices. In addition, with the more uniformly maintained temperature within the refrigerated cases, which the present invention will allow, it is also expected that the shelf-life of refrigerated food stuffs may be extended. The degree of consumer comfort will also be increased in the proximity of such modified refrigerated cases because the ambient air will no longer turn the supermarket into a "mini-freezer." This invention is thus susceptible to a wide variety of beneficial uses.

I claim:

1. A shield assembly for thermally isolating an aperture in a refrigerated device while permitting access to the aperture, comprising:

(a) a plurality of resilient, substantially transparent panels each having first and second ends, said panels arranged in a partially overlapping, side-by-side configuration and wherein said second end of said panels is spaced from said aperture so as to define an opening permitting air to flow from between said panels and said aperture to a location external to said refrigerated device;

(b) means disposed along the length of said panels, for stiffening and selectively retaining said panels in a predetermined pattern said stiffening means comprises an elongated member which extends from a first position adjacent a first end of a panel to a second position adjacent a second end of a panel;

(c) mounting means disposed adjacent said first end of said panels for mounting said panels to said refrigerated device such that said panels extend across said aperture, said mounting means being rotatable about an axis generally perpendicular to the length of said panels; and (d) means, disposed adjacent to and selectively engaging said second end of said panels, for maintaining said panels across said aperture.

2. A shield assembly according to claim 1 wherein said stiffening means and said mounting means urge said panels away from the aperture in said refrigerated device.

3. A shield assembly according to claim 2 wherein said stiffening member is a generally flat piece of flexible metal.

4. A shield assembly according to claim 2 wherein said stiffening member is an elongated metal bar joined to said mounting means.

5. A shield assembly according to claim 1 wherein said mounting means comprises a rail assembly having a guide member and a track defining an elongated slot for engaging said guide member.

6. A shield assembly according to claim 5 wherein said rail assembly comprises a housing defining an opening along one side thereof and a spring member is disposed in said housing; and further wherein a cuff member having first and second flanges is attached to said first ends of said panels, said cuff member being disposed in said opening such that said first flange projects through said opening, and said spring member urges said second flange away from said opening.

7. A shield assembly according to claim 1 wherein said mounting means comprises:

a track member of generally arcuate cross-section having a slot extending longitudinally along said track member; and a rail assembly provided with an arcuate guide member for coupling said rail assembly to said track member, said slot spanning an arc sufficient to permit said arcuate guide member to pass therethrough, whereby said rail assembly is coupled to said track member so as to permit said rail assembly to rotate a limited extent about the longitudinal axis of said track member.

8. A shield assembly according to claim 1 wherein said maintaining means comprises an elongated railing assembly configured to selectively engage said second end of said panels.

9. A shield assembly according to claim 8 wherein said maintaining means further comprises means for maintaining said railing assembly a predetermined distance from said refrigerated device, adjacent said aperture.

10. A shield assembly according to claim 8 wherein said railing assembly includes a first arm member for selectively engaging said panels adjacent said second end thereof.

11. A shield assembly according to claim 5 wherein said mounting means further includes means for retaining said guide member in a predetermined position, selectively engaging said panels adjacent said second end thereof.

12. A shield assembly according to claim 1 wherein said stiffening means is disposed in each said panel.

13. A shield assembly according to claim 1 wherein each said panel comprises first and second sections joined together along the length thereof, and said stiffening means is disposed along the length of the joint.

14. A shield assembly for thermally isolating an aperture in a refrigerated device while permitting access to the aperture, comprising:

(a) a plurality of resilient, substantially transparent panels each having first and second ends, said panels arranged in a partially overlapping, side-by-side configuration and wherein said second end of said panels is spaced from said aperture so as to define an opening permitting air to flow from between said panels and said aperture to a location external to said refrigerated device;

(b) an elongated stiffening member disposed in each said panel along the length thereof; and (c) mounting means joined to each said panel adjacent said first end thereof for joining said panels to said refrigerated device and for retaining said stiffening member such that said panels extend across said aperture and are urged outwardly from said aperture, said mounting means including a first member joined to said first end of said panel, and a second member for joining to said refrigerated device, and further wherein said mounting means is rotatable about an axis generally perpendicular to the length of said panels.

15. A shield assembly according to claim 14 wherein said first member of said mounting means comprises a rail assembly having a guide member, and said second member of said mounting means comprises a track defining an elongated slot for selectively engaging said guide member.

16. A shield assembly according to claim 14 further including an elongated railing assembly configured to selectively engage said panels adjacent said second end thereof.

17. A shield assembly according to claim 16 wherein said mounting means includes means for fixedly joining said stiffening member thereto.

18. In a refrigerated device having an aperture the improvement comprising a shield assembly joined to said device for substantially isolating said aperture while permitting access, said shield assembly having a plurality of resilient panels extending from a first end of said aperture to a second end thereof and wherein one end of said panels is spaced from said aperture so as to define an opening permitting air to flow from between said panels and said aperture to a location external to said refrigerated device, an elongated stiffening member disposed in each said panel along the length thereof for selectively retaining said panel in a predetermined position, means for joining one end of said panels adjacent said first end of said aperture, said joining means being rotatable about an axis generally perpendicular to the length of said panels, and means, disposed adjacent said second end of said aperture, for maintaining said panels in said predetermined position.

19. A refrigerated device according to claim 18 wherein said maintaining means comprises a railing assembly configured to maintain said panels a predetermined distance from said refrigerated device.

20. A refrigerated device according to claim 18 or 19 wherein said joining means comprises a rail assembly joined to said panels and a track joined to said refrigerated device, said rail assembly being selectively movable in said track.

21. A refrigerated device according to claim 18 wherein said joining means comprises:

a track member of generally arcuate cross-section having a slot extending longitudinally along said track member; and a rail assembly provided with an arcuate guide member, for coupling said rail assembly to said track member, said slot spanning an arc sufficient to permit said arcuate guide member to pass therethrough whereby said rail assembly is coupled to said track member so as to permit said rail assembly to rotate a limited extent about the longitudinal axis of said track member.

22. A refrigerated device according to claim 18 further including a vent assembly disposed adjacent said refrigerated device, and wherein said maintaining means is joined to said vent assembly.

23. In a refrigerated device having an aperture, the improvement comprising a shield assembly for isolating said aperture while permitting access through said aperture, said shield assembly comprising:

a plurality of resilient, substantially transparent panels having first and second ends and wherein said second end of said panels is spaced from said device so as to define an opening through which air can readily flow;

means joined to said refrigerated device for disposing said panels across said aperture and tensioning each of said panels;

means for urging said panels into a predetermined position adjacent said aperture;

means, disposed adjacent said second end of said panels, for maintaining said panels in said predetermined position, said maintaining means including a railing joined to said refrigerated device; and wherein said refrigerated device includes vent means located adjacent said second end of said panels for directing air from said opening to a location external to said refrigerated device.

24. A refrigerated device according to claim 23 further including cuff means joined to said second end of said panels for selectively engaging said railing.

25. A refrigerated device according to claim 23 or 24 wherein said urging means comprises an elongated stiffening element.

* * * * *